US005354238A

United States Patent [19]

Gaughan

[11] Patent Number: 5,354,238

[45] Date of Patent: Oct. 11, 1994

[54] LEVITATION APPARATUS

[76] Inventor: John Gaughan, 5223 San Fernando Rd., Los Angeles, Calif. 90039

[21] Appl. No.: 72,886

[22] Filed: Jun. 7, 1993

Related U.S. Application Data

[63] Continuation-in-part of Ser. No. 858,095, Mar. 26, 1992, abandoned.

[51] Int. Cl.[5] ..... A63J 5/12

[52] U.S. Cl. ..... 472/68; 472/78; 472/80

[58] Field of Search ..... 472/68, 78, 80

[56] References Cited

U.S. PATENT DOCUMENTS 3,476,385 11/1969 Foy ..... 472/68
4,392,648 7/1983 Foy ..... 472/68

*Primary Examiner*—Carl D. Friedman
*Assistant Examiner*—Beth A. Aubrey
*Attorney, Agent, or Firm*—J. E. Brunton

[57] ABSTRACT

An apparatus for use in performing levitation type illusions in which the performer appears to be raised and moved about in apparent defiance of gravity. The performer is safely supported within a novel harness assembly which, in turn, is supported by a pair of wire arrays made up of a plurality of fine wires which are substantially invisible to the audience. Each of the support wires is spring loaded so as to evenly distribute the weight of the performer among the support wires which make up the arrays. The harness assembly is connected to the wire arrays in a manner that permits several degrees of movement by the performer during lifting and movement relative to the stage so that the movements by the performer appear smooth, natural and graceful.

29 Claims, 11 Drawing Sheets

LEVITATION APPARATUS

This is a Continuation-In-Part of copending application Ser. No. 07/858,095 filed Mar. 26, 1992 now abandoned.

1. Field of the Invention

The present invention relates generally to personnel lifting and transport apparatus. More particularly, the invention concerns a theatrical apparatus for creating an illusion of levitation for the benefit of a viewing audience.

2. Discussion of the Invention

In theatrical performances it is sometimes necessary to create the illusion that a performer is being raised from the stage in seeming defiance of gravity and is "floating" about in an apparently unsupported manner. Representative of such performances is the well-known play "Peter Pan" wherein the performer seemingly flies about the stage in defiance of gravity.

In the past, levitation illusions were typically accomplished by attaching the lower end of a cable to a harness of some kind which was worn by the performer and attaching the upper end of the cable to some type of overhead trolley system which was located out of view of the audience. One such apparatus is disclosed in U.S. Pat. No. 3,476,385 issued to Foy. Another improved system of this general character is disclosed in U.S. Pat. No. 4,392,648 also issued to Foy.

In the prior art levitation systems it is obviously necessary to provide a supporting cable for supporting the performer that is strong enough to safely transport the performer above the stage. Such a cable is of necessity relatively large in diameter and, therefore, easily seen by the audience. This, of course, negates the illusion intended to be presented. Additionally, when a single cable is used to levitate the performer, precision maneuvering and orientation of the performer is most difficult, frequently making the performer's movements appear clumsy and unrealistic.

The apparatus of the present invention uniquely overcomes the drawbacks of the prior art systems by providing an apparatus in which the performer is supported by a plurality of very fine, spaced apart wires that are substantially invisible to the audience. To render the illusion that the performer is apparently defying gravity, the fine wires are disposed in a pair of fanshaped arrays which are connected to a performer harness of highly novel design. The wire support arrays are always automatically maintained in a plane extending generally perpendicular to the viewing direction of the audience. In this way the wires can never come into alignment with one another along the direction of sight of the viewer and, therefore, at all times, remain essentially invisible to the audience. Because the performer is always supported by the combined strength of the wires, his safety is assured.

To enable precise maneuverability of the performer, the wire arrays are connected to either side of the aforementioned performer harness assembly which is preferably concealed beneath the performer's clothing. The connection between the wire arrays and the performer harness uniquely permits free movement of the harness about several axes of rotation which enables the performer to move about in a smooth and naturally appearing manner. For example, the performer can freely rock forwardly and backwardly and can also move from side to side as the harness pivots relative to the wire arrays.

The wire support arrays are positively interconnected with an overhead operating system that controllably raises, lowers and turns the performer. As previously mentioned, the novel overhead operating system also automatically maintains the fan shaped wire arrays always in a plane substantially perpendicular to the viewing direction of the audience so as to maintain the integrity of the illusion.

SUMMARY OF THE INVENTION

It is an object of the present invention to provide an apparatus which can be used in performing levitation type illusions in which the performer appears to be raised and moved about in apparent defiance of gravity.

It is another object of the invention to provide an apparatus of the aforementioned character in which movements of the performer during and after levitation appear smooth, natural and graceful.

Another object of the invention is to provide an apparatus for lifting the performer which is safe and easy to use and requires minimum set-up time.

Another object of the invention is to provide an apparatus as described in the preceding paragraphs in which the performer is safely supported by a pair of wire arrays made up of a plurality of fine wires which are substantially invisible to the audience.

Another object of the invention is to provide an apparatus of the character described in which each of the support wires is spring loaded so as to evenly distribute the weight of the performer among the support wires which make up the arrays.

Still another object of the invention is to provide an apparatus as described in the preceding paragraph in which the performer is comfortably supported in a novel harness assembly which is connected to the wire arrays in a manner that permits several degrees of movement by the performer during lifting and movement relative to the stage.

Yet another object of the invention is to provide an apparatus of the class described which is light weight, easily transported and stored and one which can be quickly assembled and used in virtually any theater.

BRIEF DESCRIPTION OF THE DRAWINGS

FIG. 19 is an enlarged, cross-sectional view taken along lines 19—19 of FIG. 18.

FIG. 22 is a cross-sectional view taken along lines 22—22 of FIG. 21.

DESCRIPTION OF THE INVENTION

Figure 1A:
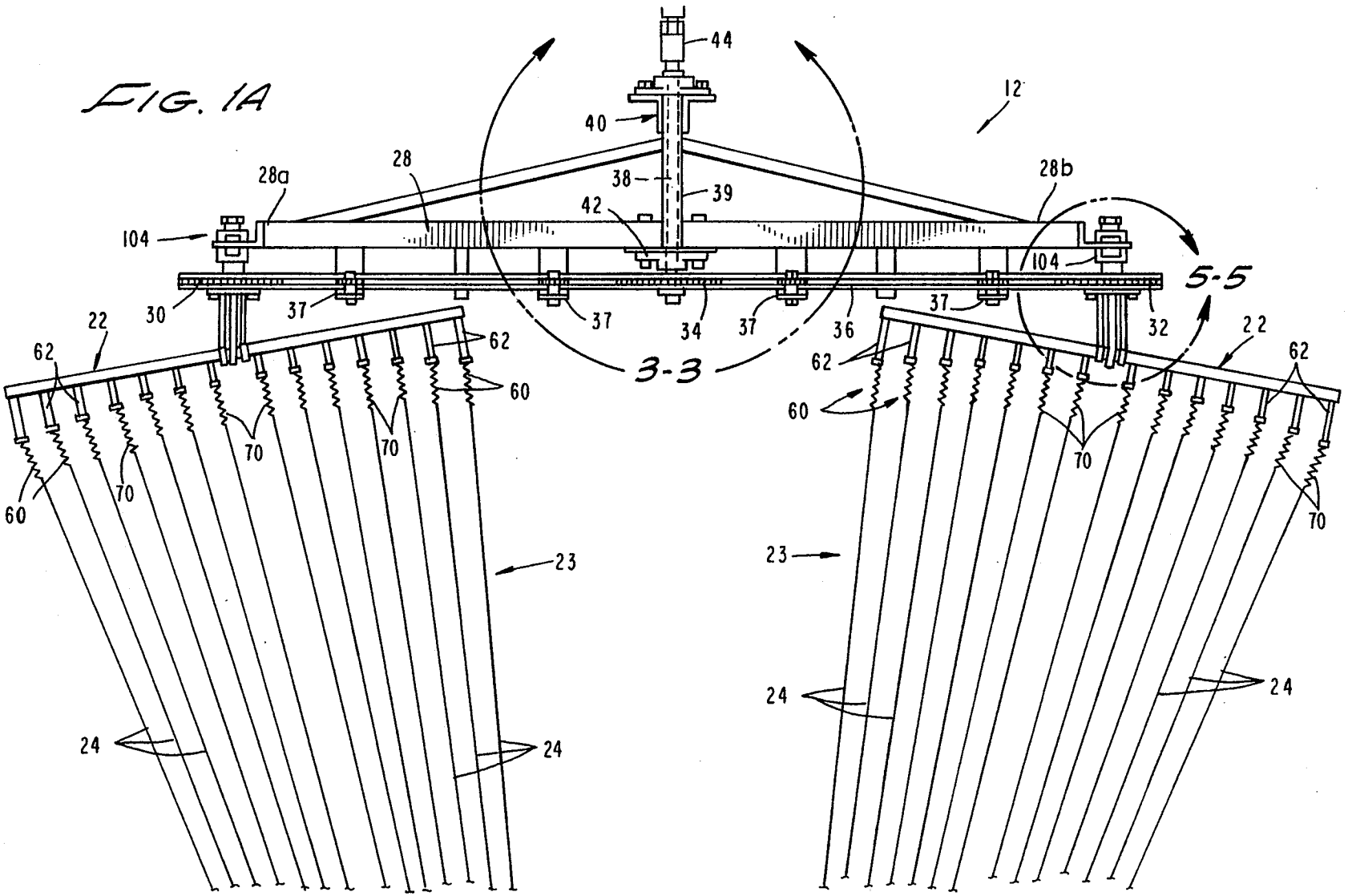
FIG. 1A is a front elevational view of the upper portion of one form of the levitation apparatus of the present invention.

Referring to the drawings and particularly to FIGS. 1A, 1B, 2 and 3, the theatrical apparatus of one embodiment of the invention for performing a levitation type illusion is there illustrated and generally identified by the numeral 12. In this form of the invention, the apparatus comprises harness means for interconnection with the performer, performer support means interconnected with the harness means and rotator means for moving the performer support means and the performer about the stage.

Figures 1B, 8:
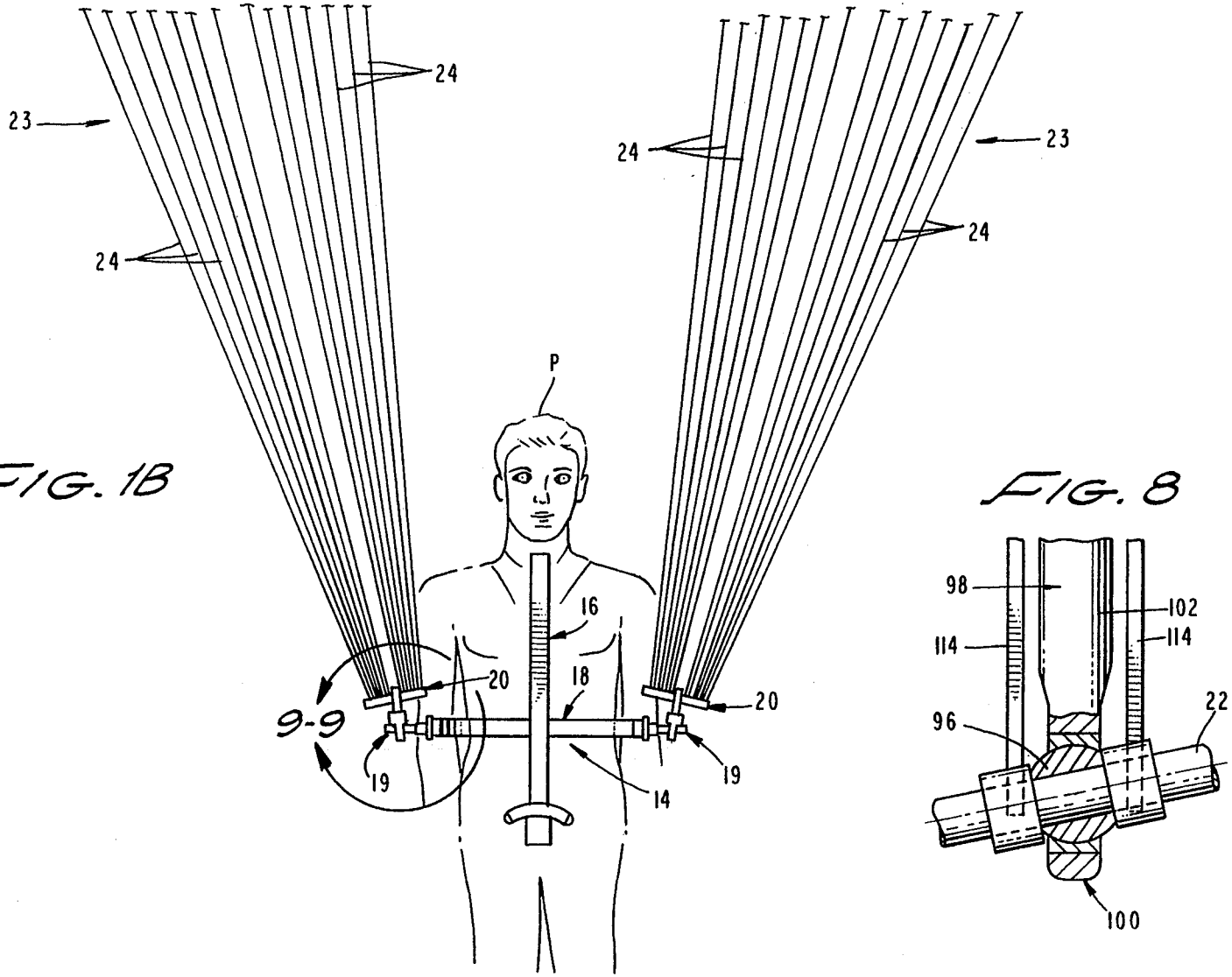
FIG. 1B is a front elevational view of the lower portion of the levitation apparatus shown in FIG. 1A.
FIG. 8 is a greatly enlarged fragmentary side view of the swivel subassembly shown in FIG. 6.

As best seen in FIG. 1B, the harness means here comprises a harness assembly 14 having a first member 16 upon which the performer is seated and a second, interconnected member 18 which extends partially around the performer's waist. Members 16 and 18 cooperate to provide a cradle-like structure within which the performer is positioned in a stable, natural and comfortable position. Connected on either side of member 18 is a connector assembly 19 which includes a pair of first, rod-like connector elements 20 which, in a manner presently to be described, are always maintained within a plane that extends substantially perpendicular to the viewing direction of the audience for which the illusion is being performed.

The performer support means of the form of the invention shown in the drawings comprises a pair of second connector elements 22 which, as shown in FIG. 1A, are elevated with respect to first connector elements 20. Each pair of elements 20 and 22 are interconnected by a fan shaped support array 23, here comprising a plurality of spaced-apart, very fine steel wires 24. In a manner presently to be described, support arrays 23 are also always maintained in a plane which extends generally perpendicular to the direction of sight of the viewing audience. Wires 24 are preferably about 0.010 inches in diameter, each having the ability to support about twenty-two pounds thereby providing in combination more than adequate support for the performer. To make them less visible to the audience, each wire is painted a dark color. Also comprising a part of the apparatus of the present form of the invention is rotator means for controllably rotating the performer support means, including second connector elements 22 and wire support arrays 23.

Figures 2, 3, 4:
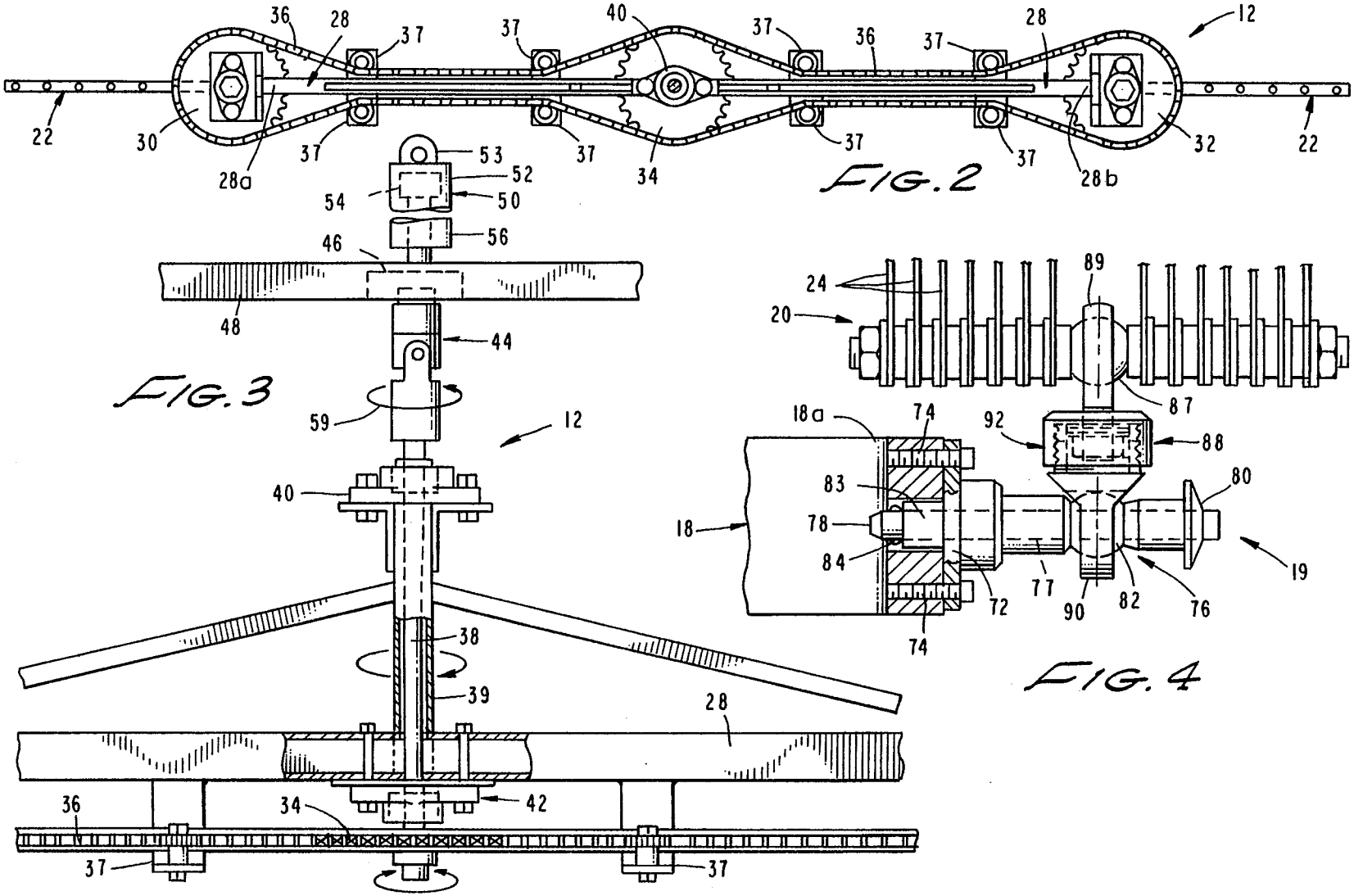
FIG. 2 is a top view of the apparatus.
FIG. 3 is an enlarged fragmentary view of the portion of the apparatus identified by lines 3—3 of FIG. 1A.
FIG. 4 is a greatly enlarged fragmentary view of the harness coupling portion of the apparatus.

As best seen by referring to FIGS. 1A, 2 and 3, the rotator means of this embodiment of the invention comprises an elongated support beam 28 having first and second ends 28*a* and 28*b*. A first, driven wheel, or sprocket 30, is rotatably connected to support beam 28 proximate first end 28*a*. In similar fashion a second driven wheel, or sprocket 32, is connected to the support beam proximate its second end 28*b* (FIG. 2). A driving wheel, or sprocket 34, is rotatably connected to beam 28 proximate the center thereof and functions via appropriate driving means to driven driven sprockets 30 and 32. As best seen by referring to FIG. 2 and 3, this driving means here comprises a length of chain 36 which interconnects driving wheel 34 with driven wheels 30 and 32. Tensioning assemblies 37 maintain appropriate driving tension on the chain.

Also comprising a part of the driving means is a drive shaft 38 to which driving wheel 34 is operably connected. As best seen in FIG. 3, drive shaft 38 is rotatable within a tubular housing 39 which is connected at its lower end as by welding to support beam 28. Provided proximate the upper end of tubular housing 39 is a bearing assembly 40 which, along with a lower bearing assembly 42, which is mounted on support beam 28, rotatably supports drive shaft 38.

Drive shaft 38 is rotated via a universal joint 44 by a motor 46 which comprises a part of the rotator means and which is mounted on an elevated supporting structure which includes a main beam 48. Main beam 48 is disposed above support beam 28 and like support beam 28 is out of view of the audience. Main beam 48, along with support beam 28, can be raised and lowered by lifting means here shown as a hydraulic lifting assembly 50. Assembly 50 includes a cylinder 52 within which a piston 54 reciprocates. Cylinder 52 can be supported from a fixed theater beam or the like by using eyelet 53. Connected to piston 54 is a connecting rod 56 which, in turn, is connected to main beam 48. With this construction, actuating of the hydraulic lifting assembly enables lifting and lowering of main beam 48 and the rotator means interconnected therewith. It is to be understood that main beam 48 can alternatively be raised and lowered by existing theater rigging such as a chain hoist, an electric motor, or by various other expedients well known to those skilled in the art.

Figure 10:
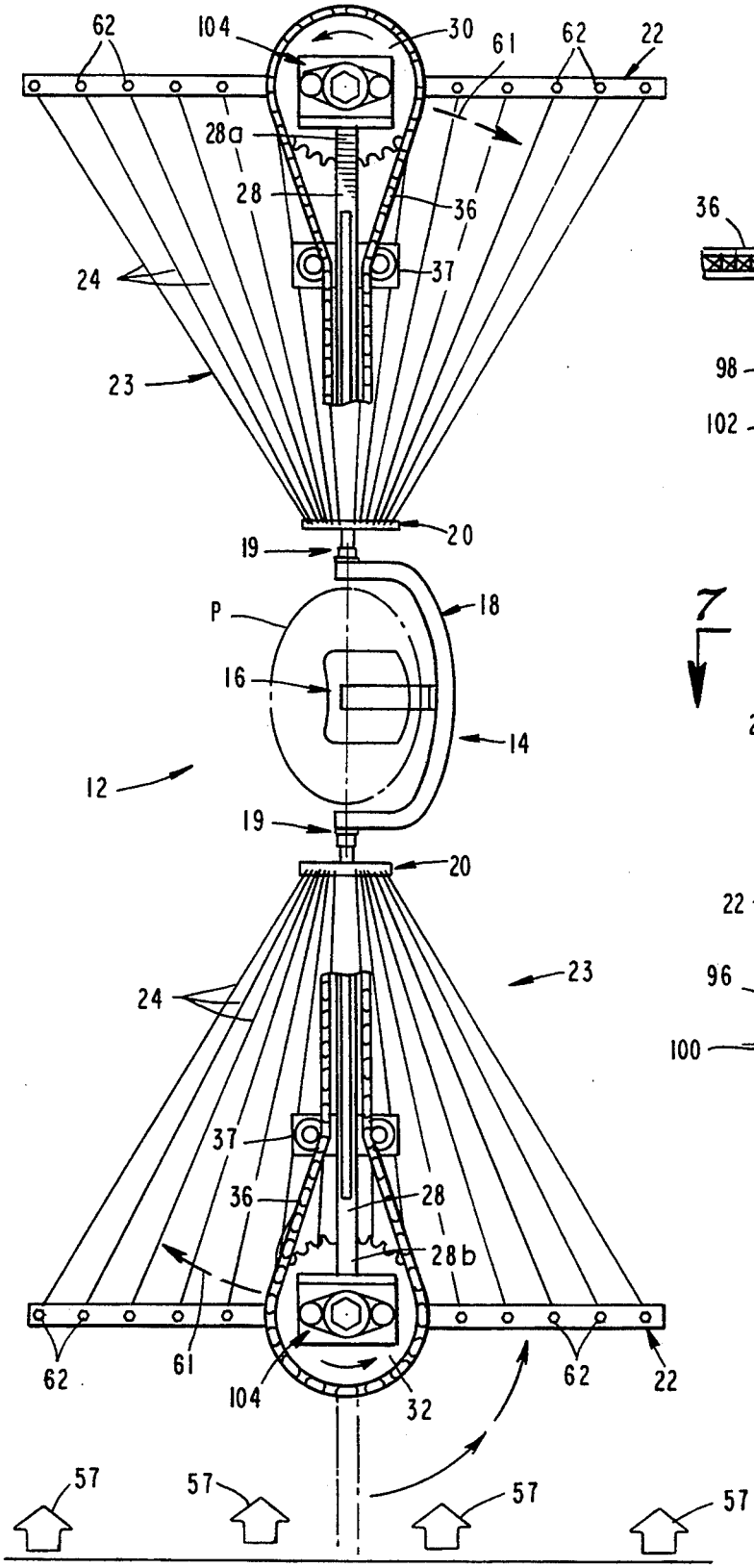
FIG. 10 is a top view of the apparatus similar to that shown in FIG. 2 but showing the cable support subassembly rotated 90 degrees.

Turning now to FIG. 10, it is to be observed that support beam 28 has been rotated by motor 46 in a clockwise direction approximately 90 degrees from the starting position shown in FIGS. 1A and 2. This rotation of support beam 28 causes movement of the performer P from a position facing the audience to a sideways position relative to the audience as shown in FIG. 10, the viewing direction of the audience being identified by the arrows 57. Referring also to FIG. 3, it can be seen that this rotation was accomplished by rotating drive shaft 38 in a counterclockwise direction as indicated by the arrow 59. This rotation of shaft 38 caused concomitant rotation of sprockets 30, 32 and 34 in a counterclockwise direction and rotation of support beam 28 in an opposite, or clockwise direction indicated by the arrows 61 in FIG. 10. It is to be noted that the performer is now facing away from the viewing direction of the audience. It is also important to note that the rotation of sprockets 30 and 32 has caused simultaneous rotation of the pairs of first and second connector elements 20 and 22 and the two, fan-shaped wire arrays which are connected thereto. A study of FIG. 1A, 1B and 10 shows that the two fan-shaped arrays 23 have remained within planes substantially perpendicular to the viewing direction of the audience as indicated by the arrows 57. Because the wires have, at no time, come into alignment with one another as they are viewed by the audience, they have remained substantially invisible during the rotation of the performer from the position shown in FIGS. 1A and 1B to the position shown in FIG. 10.

Figures 9, 11:
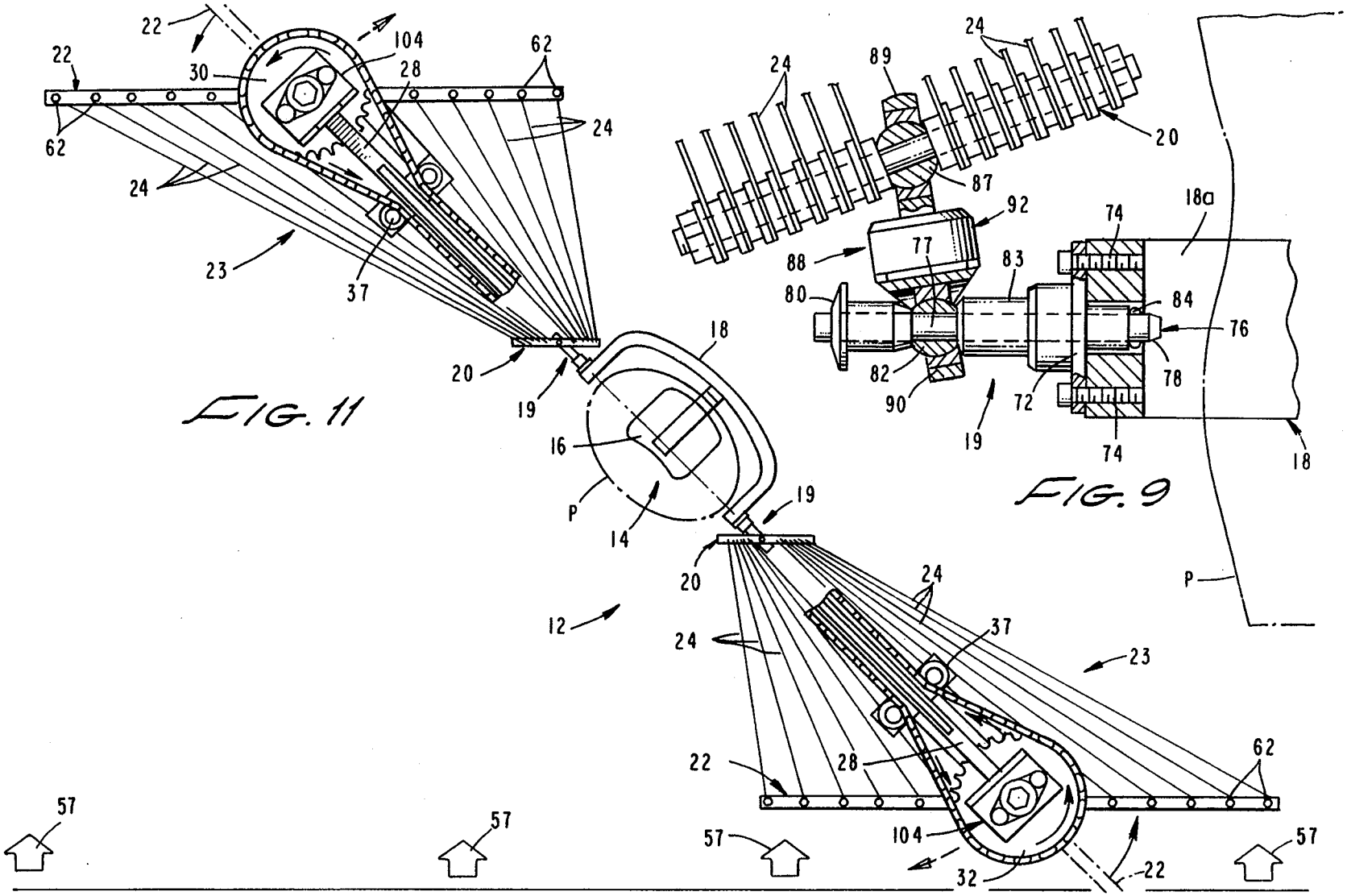
FIG. 9 is a greatly enlarged fragmentary view of the portion of the apparatus designated as lines 9—9 in FIG. 1B.
FIG. 11 is a top view of the apparatus similar to that shown in FIG. 10 but showing the cable support assembly rotated to yet another position.

Referring now to FIG. 11, it is to be noted that continued rotation of support beam 28 has moved the performer P to yet another position wherein he is partially facing the audience. It is to be observed that in this position, first and second connector elements have also been rotated by sprockets 30 and 32 so that the wire arrays continue to reside in planes generally perpendicular to the viewing direction of the audience as indicated by the arrows 57 in FIG. 11. This important aspect of the apparatus of the invention maintains the illusion of levitation of the performer during a complete 360° rotation of the performer relative to the audience. Unlike the prior art systems, where the performer was supported by a single, relatively large diameter cable, the apparatus of the present invention permits movement of the performer relative to the audience in a manner such that the fine supporting wires 24 never come into alignment and are, therefore, never visible to the audience.

Figure 5:
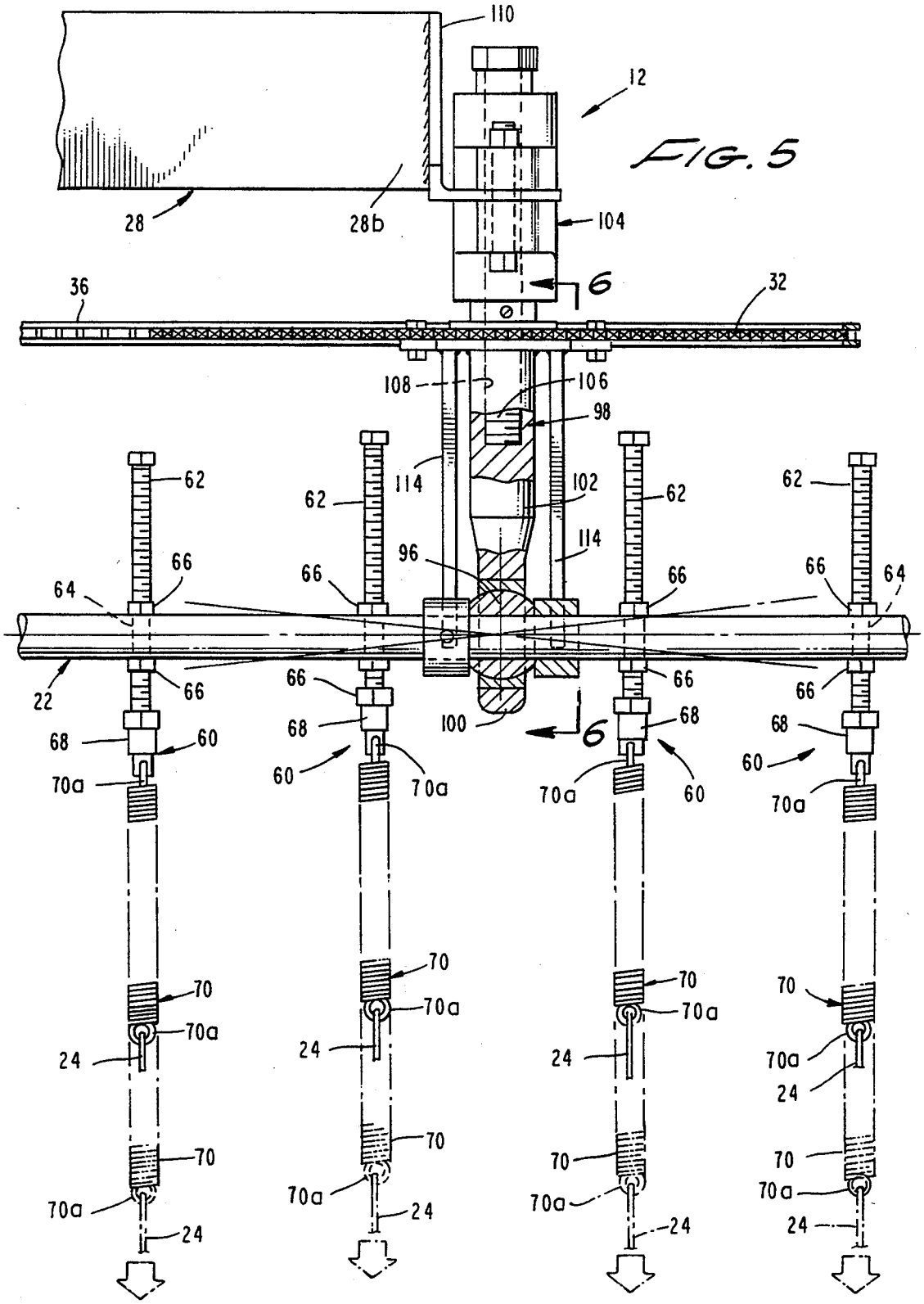
FIG. 5 is a greatly enlarged fragmentary view of the portion of the apparatus designated as 5—5 in FIG. 1A.

Turning now particularly to FIGS. 1A and 5, another important aspect of the invention resides in the provision of distribution means for uniformly distributing the weight of the performer among the support wires 24. In the form of the invention shown in the drawings, this load distribution means which comprises a part of the performer support means, includes a plurality of adjustable spring assemblies generally designated by the numeral 60. As best seen by referring to FIG. 5, each of the spring assemblies 60 is interposed between one of the connector elements 22 and one of the fine support wires 24. The spring assemblies 60 are of identical construction, each comprising a threaded rod 62 which extends through an aperture 64 provided in the connector element 22. Nuts 66 are provided on each side of each aperture 64 so that rod 62 can be threadably adjusted upwardly and downwardly relative to the connector elements. Provided at the lower end of each rod 62 is an adapter 68 the purpose of which will presently be described. Each spring assembly 60 further includes biasing means, shown here as a coil spring 70, which functions to absorb any shock which may be imparted to the supporting wire 24 with which it is associated during movement of the performer about the stage. Each spring 70 is provided with an upper and lower eyelet 70*a* with the upper eyelet being interconnected with adaptor 68 and with the lower eyelet being interconnected with a selected wire 24. With this construction, each of the spring assemblies can be adjusted relative to its supporting connector element 22 so as to achieve optimum loading of the arrays 23. Experience has shown that for best results, the two sets of spring assemblies are disposed in the generally arcuate configuration illustrated in FIG. 1A with the spring assemblies located proximate the ends of the connector elements 22 extending further downwardly from the connector elements than those located proximate the center of the connector elements. Due to the novel construction of the distribution means just described, the weight of the performer can be uniformly distributed among the support wires 24 and, in the event of any quick or jerky movement of the performer within the support harness, the load distribution means functions to absorb any shock to the supporting wires that might result.

Turning now to FIGS. 4 and 9 it is to be noted that each of the supporting wires 24 is connected proximate its lower extremity with one of the first connector elements 20 in a manner such that each wire is uniformly spaced apart from the adjacent wire. The connector elements 20 comprise a part of the previously identified, identically constructed connector assemblies 19 which also include a connector plate 72. Connector plates 72 are suitably connected at each side of member 18 of the supporting harness by fasteners 74. Extending outwardly from each plate 72 is a rod assembly 76 which comprises a rod 77 having an inboard end 78 and an outboard end 80. Disposed intermediate ends 78 and 80 of each rod is a spherical, ball bearing-like member 82. Each rod 77 extends through, and is rotatable within, an outer sleeve 83 which is connected to plate 72. Rods 77 are removably located in place within sleeves 83 by a detent assembly 84.

A ball bearing-like member 87 is also provided proximate the center of each of the first connector elements 20. Interconnecting spherical element 87 of each connector assembly 19 is a unique swivel assembly 88. Each swivel assembly 88 comprises upper and lower ring-like collar elements 89 and 90. As best seen in FIG. 9, collar element 89 surrounds spherical member 84, while collar member 90 surrounds spherical member 82. Disposed intermediate collar elements 89 and 90 is a bearing assembly 92 which uniquely permits relative rotation between collars 89 and 90 about the axis of bearing assembly 92. With this construction, connector element 20 is free to rotate both about the axis of rod 77 and also about the axis of the bearing assembly 92. It is also free to swivel within collar 89 in the manner shown in FIG. 9. As can also be observed by a study of FIG. 9, the entire swivel assembly 88 is also free to swivel about spherical member 82. It is apparent that this multiaxis rotation permits the performer to freely move forwardly, rearwardly and from side to side relative to connector elements 20, For example, by leaning slightly forwardly or rearwardly in the harness assembly, the harness along with the performer will freely rotate about the longitudinal axis of rods 77. Similarly, as the performer is moved about, the connector elements 20 can rotate about the axis of swivel assemblies 88, can freely swivel relative to spherical members 87 and the entire assembly can swivel relative to spherical members 77.

Turning now to FIG. 5, it is to be noted that second connector element 22 is also provided with a substantially centrally located spherical, ball bearing-like member 96 which is interconnected with support beam 28 by a connector assembly 98. Connector assembly 98 comprises a ring-like collar 100 which is provided at the lower extremity of an internally threaded connector rod 102. Connector rod 102 threadably receives an upper bearing assembly 104 which comprises a threaded stud 106 which is threadably receivable within the internally threaded bore 108 provided in connector member 102. As shown in FIG. 5, bearing assembly 104 is interconnected with support means 28 by means of a generally L-shaped bracket 110 functions to rotatably support sprocket 32. With this construction connector element 22 is free to swivel about spherical member 96 just as connector element 20 is free to swivel about spherical member 87.

Figure 6:
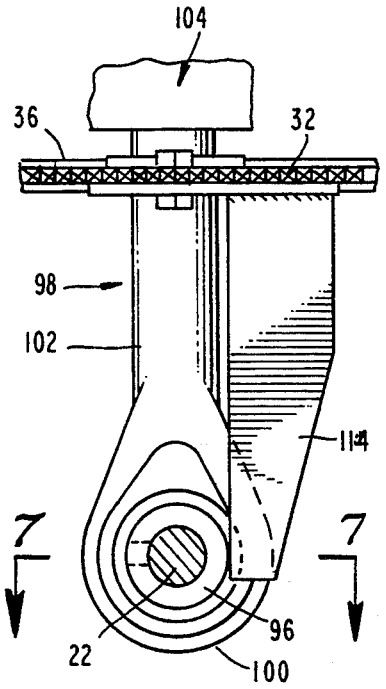
FIG. 6 is a view taken along lines 6—6 of FIG. 5.
Figure 7:
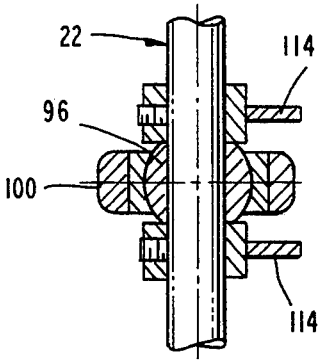
FIG. 7 is a view taken along lines 7—7 of FIG. 6.

Referring to FIGS. 6, 7 and 8, downwardly extending limiting arms 114 are provided on either side of connecting rod 102 and function to permit angular movement of connector element 22 relative to support beam 28 in the manner shown in FIG. 8 but blocked rotational movement of connector element 22 relative to the vertical axis of connecting rod 102.

The novel design of the harness means, the performer support means and the rotator means as described in the preceding paragraphs permits the performance of an elegant levitation illusion heretofore impossible.

Referring to FIGS. 12 through 22 of the drawings, an alternate embodiment of the invention for performing a levitation type illusion is there illustrated. This embodiment is similar in some respect to that shown in FIGS. 1 through 11 and like numerals are used to identify like components. In this latest form of the invention, the wire arrays which support the performer are uniquely arranged in a generally frustoconical configuration rather than in planer arrays as was the case in the earlier described embodiment. This novel approach permits the use of a greater number of smaller diameter wires making the arrays virtually invisible to the audience while still providing more than adequate support and safety to the performer.

Figure 12:
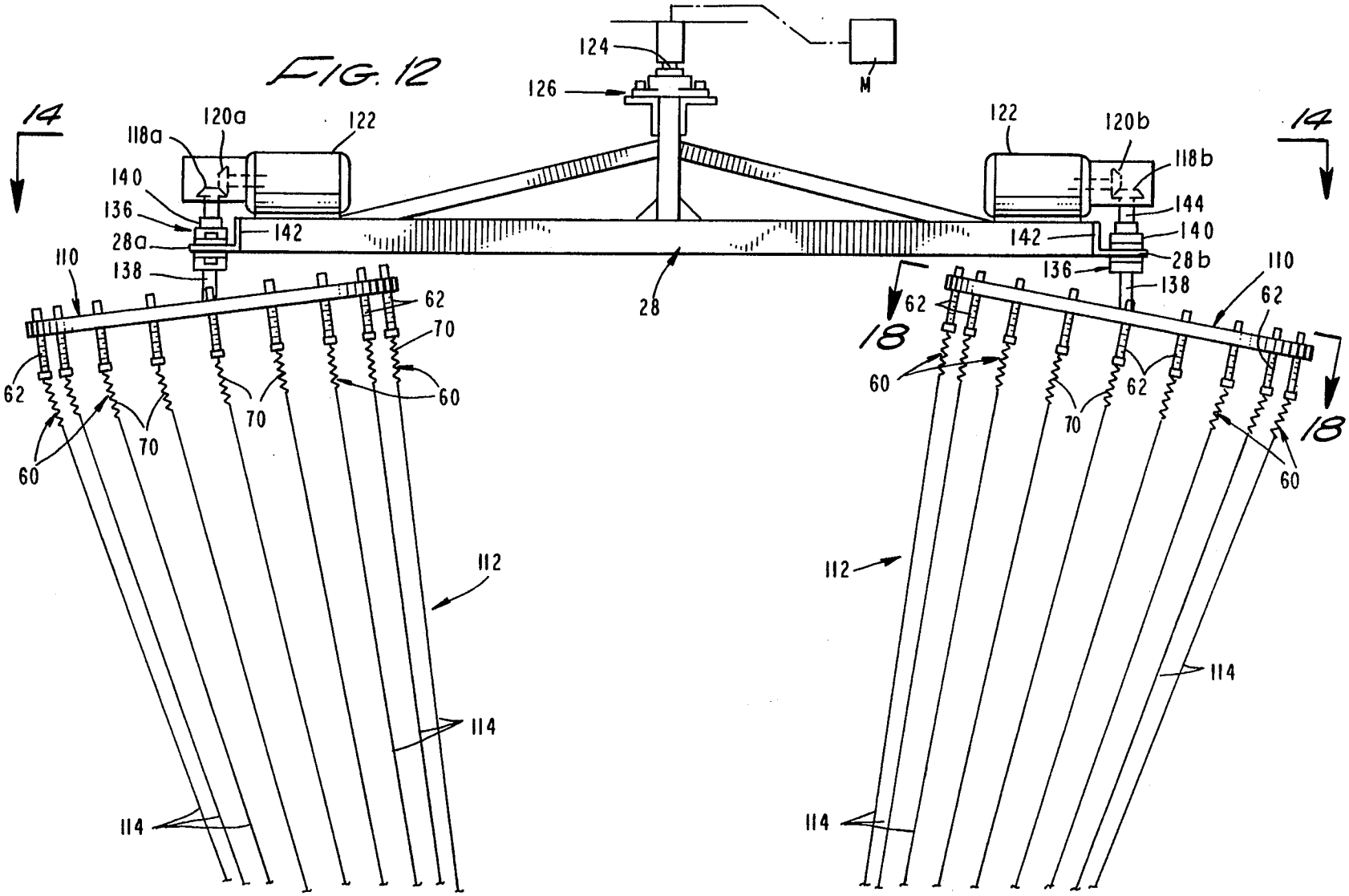
FIG. 12 is a front elevational view of the upper portion of an alternate form of the levitation apparatus of the present invention.
Figure 13:
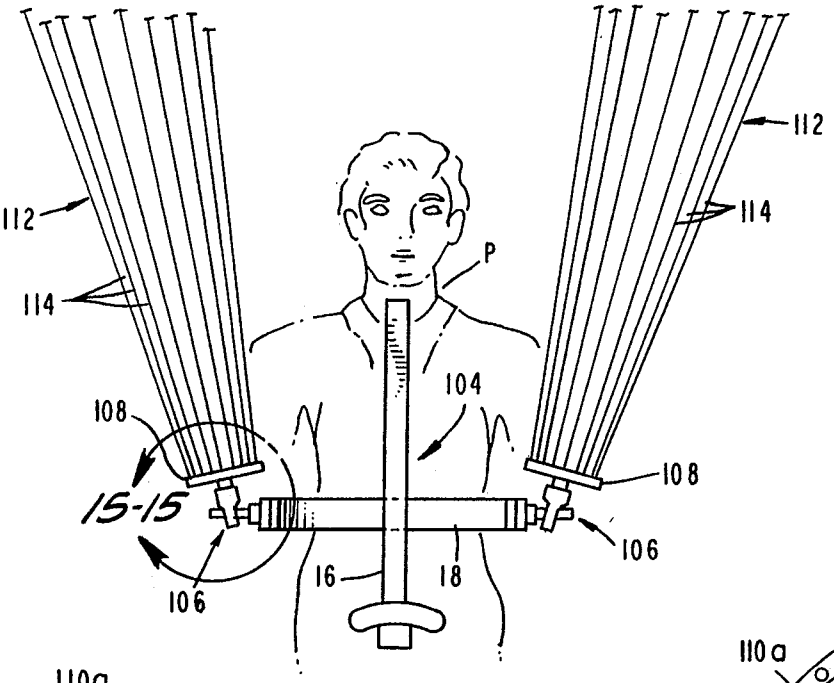
FIG. 13 is a front elevational view of the lower portion of the levitation apparatus shown in FIG. 12.

Referring particularly to FIGS. 12 and 13, the apparatus of this latest form of the invention can be seen to also comprise harness means for interconnection with the performer, performer support means interconnected with the harness means and rotator means for moving the performer support means and the performer about the stage.

As best seen in FIG. 13, the harness means here comprises a harness assembly 104 having a first member 16 upon which the performer is seated and a second, interconnected member 18 which extends partially around the performer's waist. Members 16 and 18 cooperate to provide a cradle-like structure within which the performer is positioned in a stable, natural and comfortable position. Connected on either side of member 18 is a connector assembly 106 which includes a pair of first, or lower, generally circular-shaped connector members 108 which, in a manner presently to be described, can both swivel and rotate relative to member 18.

The performer support means of this second form of the invention further comprises a pair of second, or upper connector members 110 which, as shown in FIG. 12, are elevated with respect to first connector members 108. Each pair of elements 108 and 110 are interconnected by a generally frustoconically shaped support array 112, here comprising a plurality of spacedapart, very fine steel wires 114. Wires 114 are preferably about 0.008 inches in diameter, each having the ability to support about eighteen pounds thereby providing in combination more than adequate support for the performer. As before, to make them less visible to the audience, each wire is painted a dark color. Also comprising a part of the second form of the apparatus of the invention is rotator means for controllably rotating the performer support means, including second connector members 110 and wire support arrays 112.

Figure 14:
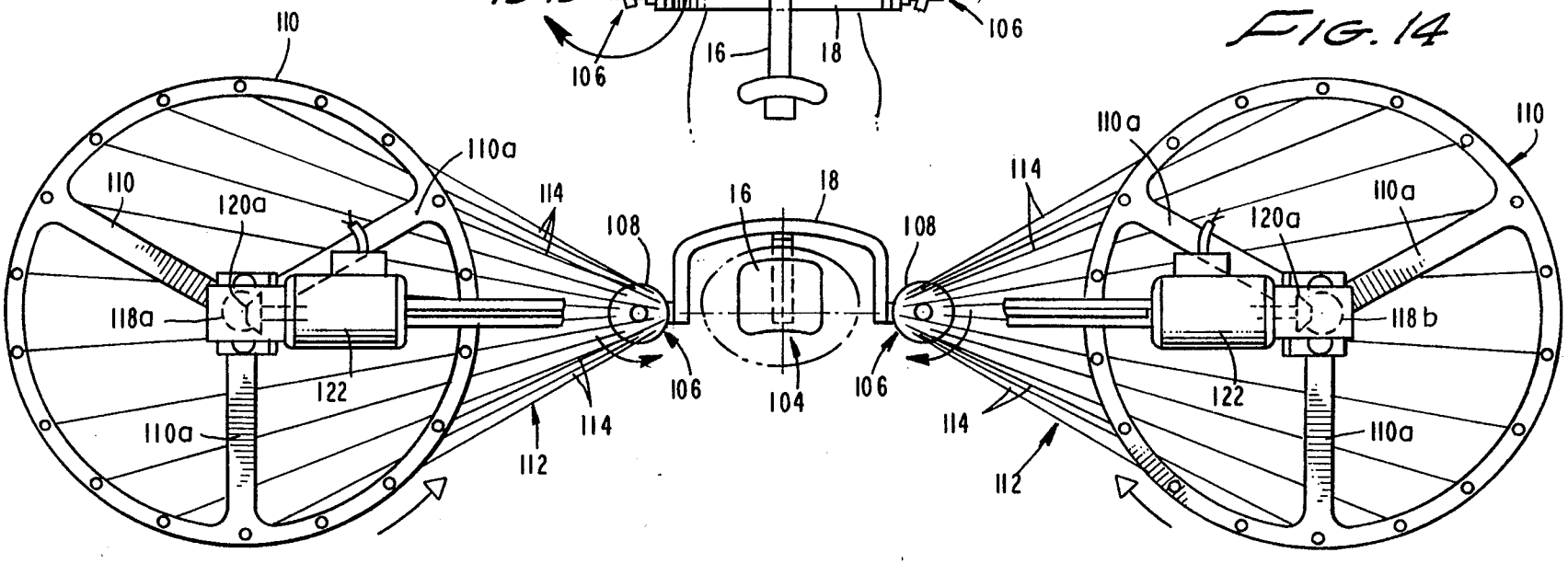
FIG. 14 is a top view of the apparatus taken along lines 14—14 of FIG. 12.

As best seen by referring to FIGS. 12, and 14, the rotator means of this embodiment of the invention is somewhat similar to that previously described and comprises an elongated support beam 28 having first and second ends **28*a* and 28*b*. A first, driven wheel, or bevel gear 118*a*, is rotatably connected to support beam 28 proximate first end 28*a*. In similar fashion a second driven wheel, or bevel gear 118*b*, is connected to the support beam proximate its second end 28*b* (FIGS. 12 and 14). A driving wheel, or bevel gear 12O*a*, is supported by beam 28 proximate end 28*a* and functions to drive driven gear 118*a*. Similarly, a driving wheel or bevel gear 120*b* is supported by beam 28 proximate end 28*b* and functions to drive gear 118*b*. Gears 120*a* and 120*b* are driven by motors 122 mounted at either end of beam 28**.

Also comprising a part of the driving means is a drive shaft 124 which controllably rotates beam 28 via a beaming assembly 126 of standard construction which is mounted on beam 28. Drive shaft 124 is rotated by a motor "M" which also comprises a part of the rotator means. As before support beam 28, can be raised and lowered by lifting means of the character previously described in connection with the first embodiment of the invention.

Rotation of support beam 28, of course, causes rotational movement of the performer P relative to the viewing audience. However, because the wires are uniquely disposed in a frustoconical configuration, they can at no time come into alignment with one another as they are viewed by the audience. Accordingly, the wires remain substantially invisible to the audience during the rotation of the performer relative to the viewing audience.

Referring now to FIG. 19, it is to be noted that as before each wire 114 of each of the arrays is connected to upper connector members 110 via spring assemblies 60 which comprise a part of the distribution means of the invention. The distribution means functions in the manner previously described with each of the spring assemblies being adjustable relative to its supporting connector member 110 so as to achieve optimum loading of the arrays 112.

Figure 15:
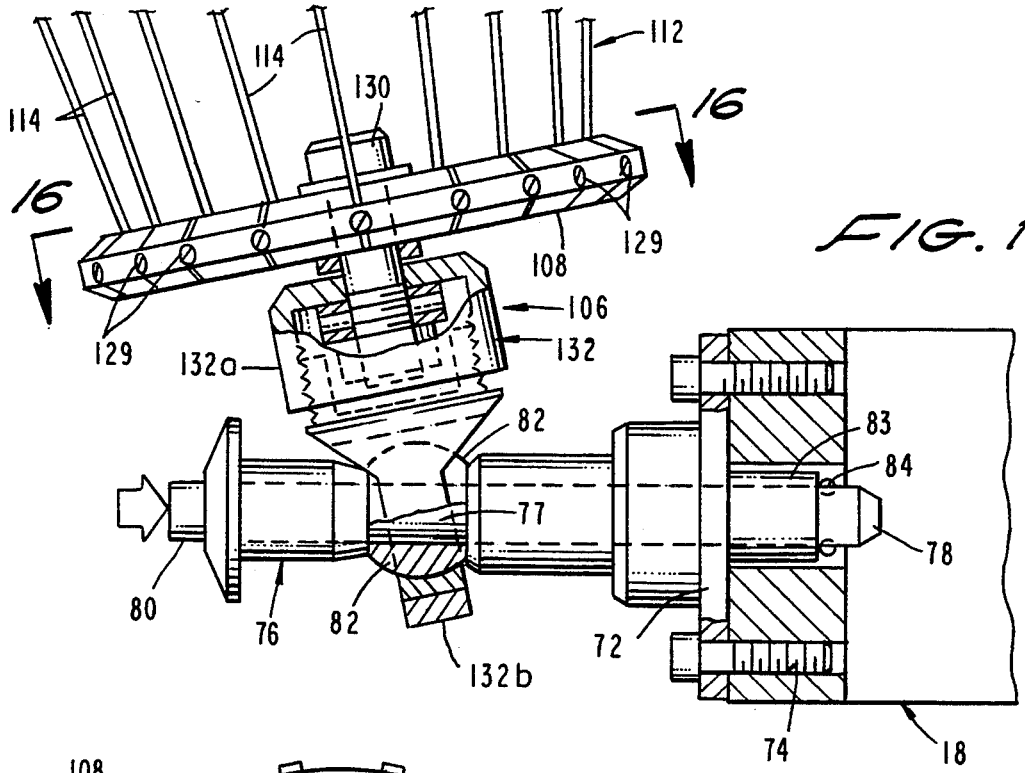
FIG. 15 is an enlarged, fragmentary view taken along lines 15—15 of FIG. 13.
Figure 16:
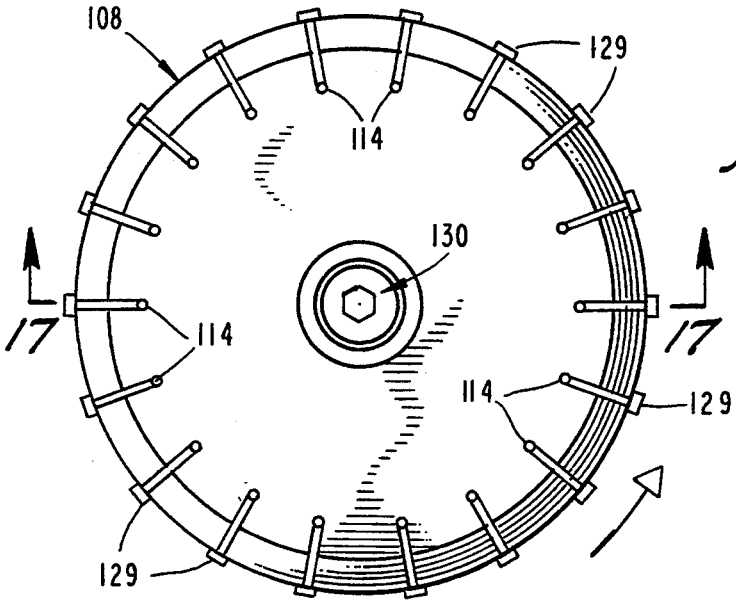
FIG. 16 is a view taken along lines 16—16 of FIG. 15.
Figure 17:
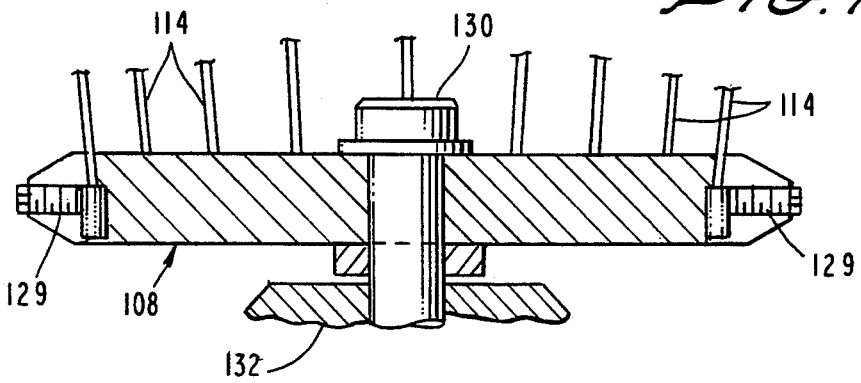
FIG. 17 is a cross-sectional view taken along lines 17—17 of FIG. 16.
Figure 18:
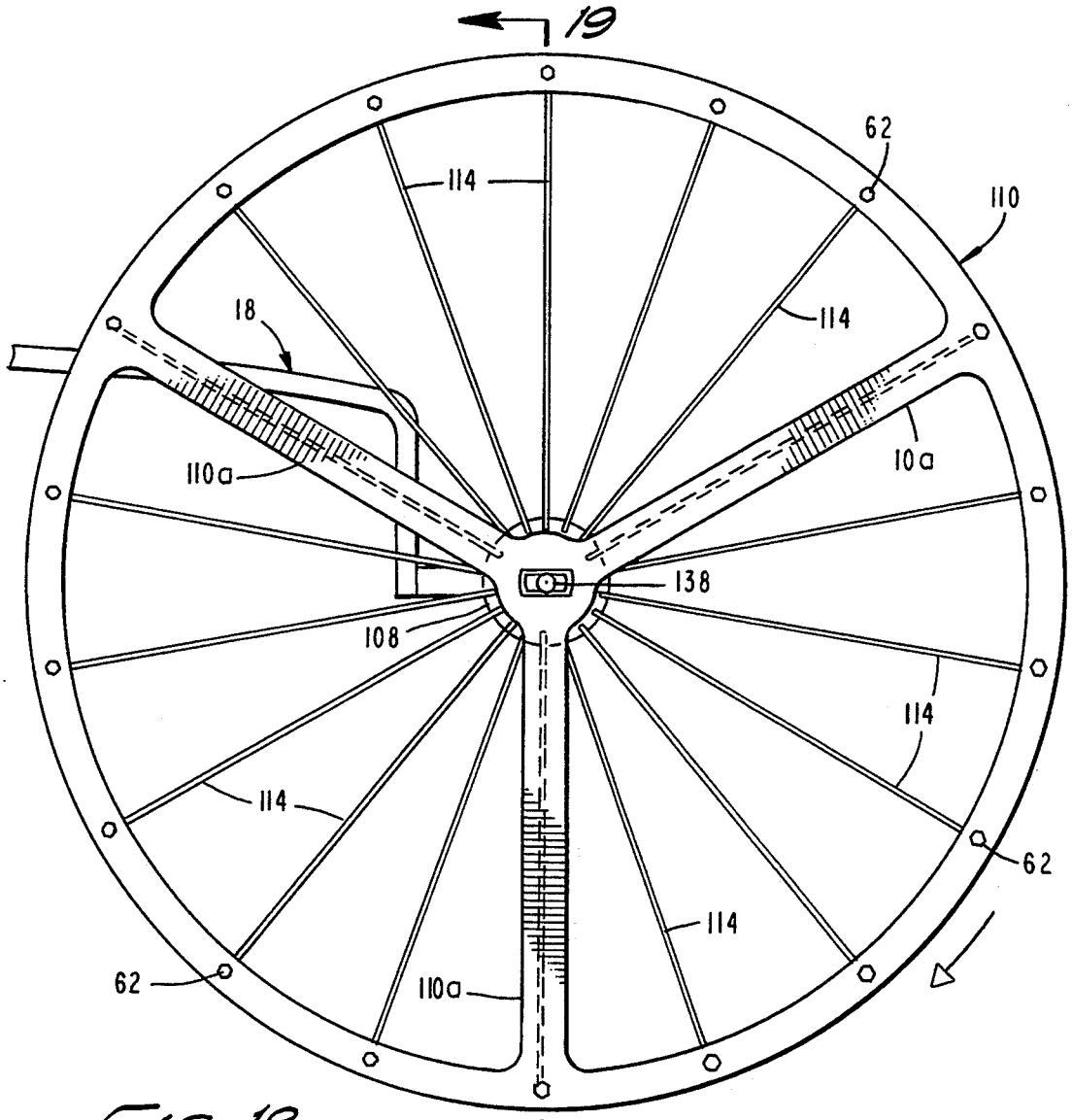
FIG. 18 is an enlarged view taken along lines 18—18 of FIG. 12.
Figure 20:
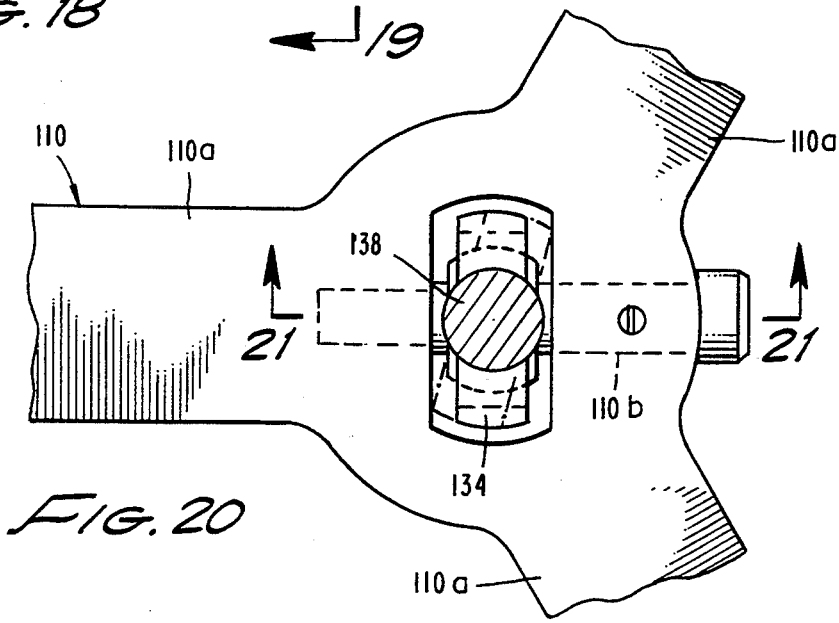
FIG. 20 is an enlarged, fragmentary top view of the apparatus taken along lines 20—20 of FIG. 19.
Figure 21:
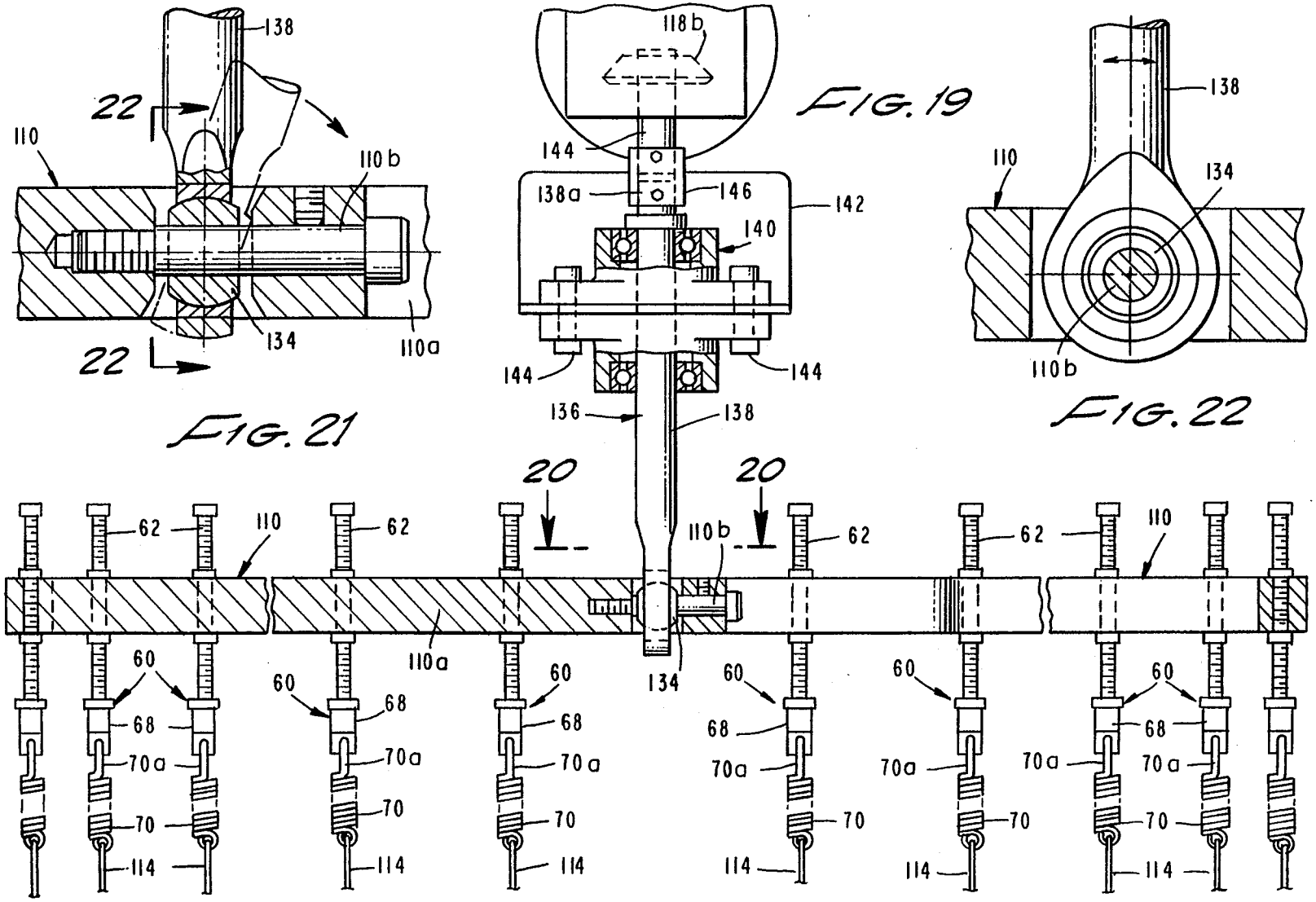
FIG. 21 is a cross-sectional view taken along lines 21—21 of FIG. 20.

Turning now to FIGS. 15, 16, and 17 it is to be noted that each of the supporting wires 114 is connected proximate its lower extremity with one of the first connector member 108 by threaded connectors 129 (FIG. 17) in a manner such that each wire is uniformly circumferentially spaced apart from the adjacent wire. The connector members 108 comprise a part of the previously identified, identically constructed connector assemblies 106 which also include a connector plate 72. Connector plates 72 are suitably connected at each side of member 18 of the supporting harness by fasteners 74. Extending outwardly from each plate 72 is a rod assembly 76 which comprises a rod 77 having an inboard end 78 and an outboard end 80. Disposed intermediate ends 78 and 80 of each rod is a spherical, ball bearing-like member 82. Each rod 77 extends through, and is rotatable within, an outer sleeve 83 which is connected to plate 72. Rods 77 are removably located in place within sleeves 83 by a detent assembly 84.

A connector bolt 130 is also provided proximate the center of each of the first connector members 108. Interconnecting bolt 130 with ball bearing like member 82 is a unique swivel assembly 132. Each swivel assembly 132 comprises upper and lower ring-like collar elements **132*a* and 132*b*. As best seen in FIG. 15, collar element 132*a* is interconnected with bolt 130 while collar member 88*b* surrounds spherical member 82. With this construction, the entire swivel assembly 132 is free to rotate relative to the axis of rod 77 and is free to swivel about spherical member 82. It is apparent that this multiaxis rotation permits the performer to freely move forwardly, rearwardly and from side to side relative to connector members 108. For example, by leaning slightly forwardly or rearwardly in the harness assembly, the harness along with the performer will freely rotate about the longitudinal axis of rods 77. Similarly, as the performer is moved about, the entire assembly can swivel relative to spherical members 82**.

Turning now to FIGS. 19 through 22, it is to be noted that second connector member 110 is also provided with a substantially centrally located spherical, ball bearing-like member 134 which is carried proximate the intersection of spoke-like members 110*a* by a bolt 110*b* interconnected with support beam 28 by a connector assembly 136. Connector assembly 136 comprises an elongated connector rod 138 which extends through a bearing assembly 140 which is interconnected with support means 28 by means of a generally L-shaped bracket 142 by fasteners 144. The upper end 138*a* of rod 138 is connected with bevel gear 118*a* via shaft 144 and coupler sleeve 146. With this construction connector member 110 is free to swivel about spherical member 134 (FIG. 21) just as connector member 108 is free to swivel about spherical member 82.

The novel design of the harness means, the performer support means and the rotator means as described in the preceding paragraphs permits the performance of an elegant levitation illusion heretofore impossible.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim

1. A theatrical apparatus for performing a levitation type illusion for the benefit of an audience looking in a viewing direction toward a stage upon which a performer is being located, said apparatus comprising:

(a) harness means for supportable interconnection with the performer, said harness means including a first connector element disposed in a plane extending substantially perpendicular to the viewing direction of the audience; and (b) performer support means interconnected with said harness means for moving said harness means relative to the audience, said performer support means comprising:

(i) a second, elevated connector element disposed in said plane;

(ii) a support array comprising a plurality of spaced apart, fine wires disposed in said plane and interconnecting said first and second connector elements; and (c) rotator means for controllably rotating said performer support means.

2. An apparatus as defined in claim 1 in which said first connector element comprises a first rod having a first length, said first rod being rotatable by said rotator means simultaneously with the rotation of said second elevated connector element.

3. An apparatus as defined in claim 2 in which said second elevated connector element comprises a second rod having a second length substantially greater than said first length of said first rod.

4. An apparatus as defined in claim 3 in which one end of each of said wires is connected to said first connector element at spaced apart locations and the other end thereof is connected to load distribution means interconnected with said second elevated connector element for smoothly distributing the weight of the performer among said plurality of wires.

5. An apparatus as defined in claim 4 in which said load distribution means comprises a coil spring connected to each of said wires and to said second connector element at spaced apart locations whereby said support array is generally fan shaped in configuration.

6. An apparatus as defined in claim 4 in which said rotator means comprises:

(a) an elevated supporting structure; and (b) lifting means operably connected to said supporting means for controllably lifting said supporting structure relative to the stage.

7. A theatrical apparatus for performing a levitation type illusion for the benefit of an audience looking in a viewing direction toward a stage upon which a performer is being located, said apparatus comprising:

(a) harness means for supportable interconnection with the performer, said harness means including a first rod like connector element disposed in a plane extending substantially perpendicular to the viewing direction of the audience; and (b) performer support means interconnected with said harness means for moving said harness means relative to the audience, said performer support means comprising:

(i) a second, elevated rod like connector element disposed in said plane;

(ii) a support array comprising a plurality of spaced apart, fine wires disposed in said plane and interconnecting said first and second rod like connector elements; and (iii) load distribution means interconnected with said second elevated connector element for smoothly distributing the weight of the performer among said plurality of fine wires.

8. An apparatus as defined in claim 7 in which said load distribution means comprises a coil spring connected to each of said wires and to said second connector element at spaced apart locations whereby said support array is generally fan shaped in configuration.

9. An apparatus as defined in claim 8 further including rotator means for controllably rotating said performer support means.

10. A theatrical apparatus for performing a levitation type illusion for the benefit of an audience looking in a viewing direction toward a stage upon which a performer is located, said apparatus comprising:

(a) harness means capable of being concealed beneath the performer's clothing for interconnection with the performer, said harness means including:

(i) a first support member partially encircling the performer;

(ii) first and second shafts connected to said first support member and extending outwardly therefrom, each said shaft having a longitudinal axis;

(iii) a bearing assembly connected to each of said shafts for rotation about the longitudinal axis thereof, said bearing assembly having an axis of rotation; and (iv) a first connector rod connected to each of said bearing assemblies for rotation about said axis of rotation of said bearing assembly; and (b) performer support means interconnected with said harness means for moving said harness means relative to the audience, said performer support means comprising:

(i) a pair of spaced apart, second connector rods disposed about said first connector rods; and (ii) a pair of support arrays each comprising a plurality of spaced apart, fine wires, said wires extending between said first and second connector rods of each pair of said first and second connector rods.

11. An apparatus as defined in claim 10 in which each said pair of first and second connector elements are disposed in a plane extending substantially perpendicular to the viewing direction of the audience.

12. An apparatus as defined in claim 10 further including rotator means for simultaneously rotating said second connector rods, said rotator means comprising an elevated supporting structure including:

(a) an elongated support beam having first and second ends;

(b) a first driven wheel rotatably connected to said support beam proximate said first end, one of said second connector rod being connected to said first driven wheel for rotation therewith; and (c) a second driven wheel rotatably connected to said support beam proximate said second end, the other of said second connector rods being connected to said second driven wheel for rotation therewith.

13. An apparatus as defined in claim 12 in which said rotator means further comprises:

(a) a driving wheel connected to said support beam intermediate said first and second driven wheels;

(b) means interconnecting said driving wheel with said first and second driven wheels for rotating said driven wheels upon rotation of said driving wheel; and (c) motor means for rotating said driving wheel.

14. An apparatus as defined in claim 13 in which said first and second elevated rods are pivotably connected to said first and second driven wheels for pivotal movement with respect thereto.

15. An apparatus as defined in claim 14 in which said performer support means further includes load distribution means for smoothly distributing the weight of the performer among said plurality of wires of said first and second support arrays.

16. An apparatus as defined in claim 15 in which said plurality of fine wires have upper and lower ends, said lower ends being interconnected with said first connector rods at spaced apart locations thereon.

17. An apparatus as defined in claim 16 in which said load distribution means comprises a plurality of coil springs each having an upper and lower end, said upper end of each said spring being connected to one of said second connector rods and said lower end of each said spring being connected to one of said plurality of the fine wires.

18. An apparatus as defined in claim 17 further including means for lifting said elongated support beam relative to the stage.

19. A theatrical apparatus for performing a levitation type illusion for the benefit of an audience looking in a viewing direction toward a stage upon which a performer is being located, said apparatus comprising:

(a) harness means for supportable interconnection with the performer, said harness means including a first generally circular-shaped connector member; and (b) performer support means interconnected with said harness means for moving said harness means relative to the audience, said performer support means comprising:

(i) a second, generally circular-shaped elevated connector member;

(ii) a generally frustoconical shaped support array comprising a plurality of circumferentially spaced apart, fine wires disposed in said plane and interconnecting said first and second connector members; and (c) rotator means for controllably rotating said performer support means.

20. An apparatus as defined in claim 19 in which said first connector member comprises a generally circular-shaped plate rotatable by said rotator means simultaneously with the rotation of said second elevated connector member.

21. An apparatus as defined in claim 20 in which said second elevated connector member comprises a generally circular shaped ring having a diameter substantially greater than the diameter of said plate.

22. An apparatus as defined in claim 21 in which one end of each of said wires is connected to said circular shaped plate at circumferentially spaced apart locations and the other end thereof is connected to said ring at circumferentially spaced locations whereby the weight of the performer is distributed among said plurality of wires.

23. An apparatus as defined in claim 22 in which said rotator means comprises:

(a) an elevated supporting structure; and (b) lifting means operably connected to said supporting means for controllably lifting said supporting structure relative to the stage.

24. A theatrical apparatus for performing a levitation type illusion for the benefit of an audience looking in a viewing direction toward a stage upon which a performer is located, said apparatus comprising:

(a) harness means capable of being concealed beneath the performer's clothing for interconnection with the performer, said harness means including:

(i) a first support member partially encircling the performer;

(ii) first and second shafts connected to said first support member and extending outwardly therefrom, each said shaft having a longitudinal axis;

(iii) a bearing assembly connected to each of said shafts for rotation about the longitudinal axis thereof; and (b) performer support means interconnected with said harness means for moving said harness means relative to the audience, said performer support means comprising:

(i) a pair of spaced apart, upper and lower, generally circular-shaped connector members; and (ii) a pair of generally frustoconical shaped support arrays each comprising a plurality of spaced apart, fine wires, said wires extending between said upper and lower connector members.

25. An apparatus as defined in claim 24 further including rotator means for simultaneously rotating said upper connector members, said rotator means comprising an elevated supporting structure including:

(a) an elongated support beam having first and second ends;

(b) a first driven gear rotatably connected to said support beam proximate said first end, one of said upper connector members being connected to said first driven gear for rotation therewith; and (c) a second driven ear rotatably connected to said support beam proximate said second end, the other of said upper connector members being connected to said second driven gear for rotation therewith.

26. An apparatus as defined in claim 25 in which said performer support means can swivel relative to said first and second shafts.

27. An apparatus as defined in claim 25 in which said performer support means further includes load distribution means for smoothly distributing the weight of the performer among said plurality of wires of said first and second support arrays.

28. An apparatus as defined in claim 27 in which said load distribution means comprises a plurality of coil springs each having an upper and lower end, said upper end of each said spring being connected to said upper connector member and said lower end of each said spring being connected to one of said plurality of the fine wires.

29. An apparatus as defined in claim 28 further including means for lifting said elongated support beam relative to the stage.

* * * * *